US007319297B2

(12) United States Patent
Kuo

(10) Patent No.: US 7,319,297 B2
(45) Date of Patent: Jan. 15, 2008

(54) BALANCED CURRENT LAMP MODULE AND MULTI-LAMP CIRCUIT

(75) Inventor: Chun-Liang Kuo, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/488,016

(22) Filed: Jul. 18, 2006

(65) Prior Publication Data

US 2007/0018593 A1 Jan. 25, 2007

(30) Foreign Application Priority Data

Jul. 22, 2005 (TW) ..... 94124963 A

(51) Int. Cl.
*H05B 41/24* (2006.01)

(52) U.S. Cl. ..... 315/282; 315/291; 315/312; 315/224

(58) Field of Classification Search ..... 315/276–278, 315/274, 282, 312, 291, DIG. 2, 224; 345/102, 345/87, 84, 55, 30; 349/70, 61, 56
See application file for complete search history.

(56) References Cited

U.S. PATENT DOCUMENTS 4,574,222 A * 3/1986 Anderson ..... 315/254
6,310,444 B1 * 10/2001 Chang ..... 315/282
6,534,934 B1 * 3/2003 Lin et al. ..... 315/312
6,717,372 B2 * 4/2004 Lin et al. ..... 315/282
6,936,975 B2 * 8/2005 Lin et al. ..... 315/224
7,061,183 B1 * 6/2006 Ball ..... 315/57
7,166,969 B2 * 1/2007 Kohno ..... 315/209 PZ

* cited by examiner

*Primary Examiner*—Douglas W. Owens
*Assistant Examiner*—Ephrem Alemu
(74) *Attorney, Agent, or Firm*—Birch, Stewart, Kolasch & Birch, LLP

(57) ABSTRACT

A balanced current lamp module driven by a power source includes a first balanced current unit, a second balanced current unit and a balanced transformer. The first balanced current unit includes a first transformer, a first lamp and a second lamp. The first transformer has one coil electrically connected with the power source, and the other coil having two ends respectively electrically connected with the first lamp and the second lamp. The second balanced current unit includes a second transformer, a third lamp and a fourth lamp. The second transformer has one coil electrically connected with the power source, and the other coil having two ends respectively electrically connected with the third lamp and the fourth lamp. The balanced transformer has one coil electrically connected with the first lamp, and the other coil electrically connected with the fourth lamp.

21 Claims, 3 Drawing Sheets

BALANCED CURRENT LAMP MODULE AND MULTI-LAMP CIRCUIT

BACKGROUND OF THE INVENTION

1. Field of Invention

The present invention relates to a lamp module and a multi-lamp circuit, and more particularly, to a balanced current lamp module and a multi-lamp circuit.

2. Related Art

Because a cold cathode fluorescent lamp (CCFL) has a high luminance, the CCFL can serve as a light source and be applied to an electronic device, such as a liquid crystal display, to serve as a backlight source.

FIG. 1 is a schematic view showing a driving circuit for a conventional balanced current lamp circuit. As shown in FIG. 1, a power source 11 is electrically connected with a coil 121 of a transformer 12, and two lamps 14 and 16 are respectively electrically connected with the other coil 122 of the transformer 12 through two capacitors 13 and 15. However, this connection method cannot ensure the working currents of the lamps 14 and 16 to be the same, and the luminance of the lamps 14 and 16 is thus different from each other.

Furthermore, FIG. 2 is a schematic view showing another driving circuit with an added balanced transformer. As shown in FIG. 2, a power source 21 is electrically connected with a coil 221 of a transformer 22. Two lamps 24 and 26 are respectively electrically connected with the other coil 222 of the transformer 22 through two capacitors 23 and 25. The lamps 24 and 26 are also electrically connected with two coils 271 and 272 of a balanced transformer 27, such that the working currents of the lamps 24 and 26 are adjusted and unified through the balanced transformer 27.

In addition, a feedback circuit 28 may also be connected with the coil 271 of the balanced transformer 27 so as to control the power source 21 in a feedback manner according to the working current of the lamp 24 and thus to adjust the working currents of the lamps 24 and 26.

Although this connection method can ensure the lamps 24 and 26 to have the same working current, the amount of balanced transformers has to be increased when the amount of lamps is increased because two lamps need one balanced transformer to ensure the working currents of the lamps to be the same. Thus, the cost is increased and the high cost is disadvantageous to the manufacture if the lamps are ensured to have the same luminance.

It is thus imperative to provide a balanced current lamp module and a multi-lamp circuit, which can control and unify the working currents of the lamps, such that the lamps can be held at the same luminance, and the amount and cost of the balanced transformers can be decreased.

SUMMARY OF THE INVENTION

In view of the foregoing, the present invention provides a balanced current lamp module and multi-lamp circuit, which can decrease the amount of the balanced transformers and ensure each lamp to have the same luminance.

To achieve the above, a balanced current lamp module according to the present invention is driven by a power source. The balanced current lamp module includes a first balanced current unit, a second balanced current unit and a balanced transformer. The first balanced current unit includes a first transformer, a first lamp and a second lamp. The first tiansformer has a first coil having two ends electrically connected with the power source and a second coil having two ends respectively electrically connected with the first lamp and the second lamp. The second balanced current unit includes a second transformer, a third lamp and a fourth lamp. The second transformer has a third coil having two ends electrically connected with the power source, and a fourth coil having two ends respectively electrically connected with the third lamp and the fourth lamp. The balanced transformer includes a fifth coil and a sixth coil, wherein the fifth coil having one end electrically connected with the first lamp and the second lamp, and the sixth coil having one end electrically connected with the third lamp and the fourth lamp.

To achieve the above, a multi-lamp circuit according to the present invention is electrically connected with a power source. The multi-lamp circuit includes a plurality of balanced current lamp modules. Each balanced current lamp module includes a first transformer having first and second coils, a second transformer having third and fourth coils, a first lamp, a second lamp, a third lamp, a fourth lamp and a balanced transformer having fifth and sixth coils. Two ends of the first coil of the first transformer and two ends of the third coil of the second transformer are electrically connected with the power source. Two ends of the second coil of the first transformer are respectively electrically connected with the first lamp and the second lamp. Two ends of the fourth coil of the second transformer are respectively electrically connected with the third lamp and the fourth lamp. One end of the fifth coil of the balanced transformer is electrically connected with the first lamp and the second lamp, and one end of the sixth coil of the balanced transformer is electrically connected with the third lamp and the fourth lamp.

To achieve the above, another multi-lamp circuit according to the present invention is electrically connected with a power source- The multi-lamp circuit includes a plurality of balanced current lamp modules and a plurality of sub-stage balanced transformers. Each balanced current lamp module includes a first transformer having two coils, a second transformer having two coils, a first lamp, a second lamp, a third lamp, a fourth lamp and a balanced transformer having two coils. Two ends of one coil of the first transformer and two ends of one coil of the second transformer are electrically connected with the power source. Two ends of the other coil of the first transformer are respectively electrically connected with the first lamp and the second lamp. Two ends of the other coil of the second transformer are respectively electrically connected with the third lamp and the fourth lamp. One end of one coil of the balanced transformer is electrically connected with the first lamp and the second lamp, and one end of the other coil of the balanced transformer is electrically connected with the third lamp and the fourth lamp. Each sub-stage balanced transformer includes two coils, wherein one end of each of the two coils of the sub-1-stage balanced transformer are respectively electrically connected with the other end of the other coil of each of the two balanced transformers, and one end of each of the two coils of the sub-N-stage balanced transformer are respectively electrically connected with the other end of the other coil of each of the two sub-(N−1)-stage balanced transformers.

As mentioned above, due to two ends of the other coil of the first transformer are respectively electrically connected with the first lamp and the second lamp, two ends of the other coil of the second transformer are respectively electrically connected with the third lamp and the fourth lamp, one coil of the balanced transformer is electrically connected with the first lamp, and the other coil of the balanced transformer is electrically connected with the fourth lamp, the working currents of each lamp are the same. Comparing with the prior art, a balanced current lamp module and a multi-lamp circuit according to the present invention can decrease the amount and cost of the balanced transformers, and ensure each lamp to have the same luminance.

BRIEF DESCRIPTION OF THE DRAWINGS

The present invention will become more fully understood from the detailed description given herein below illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
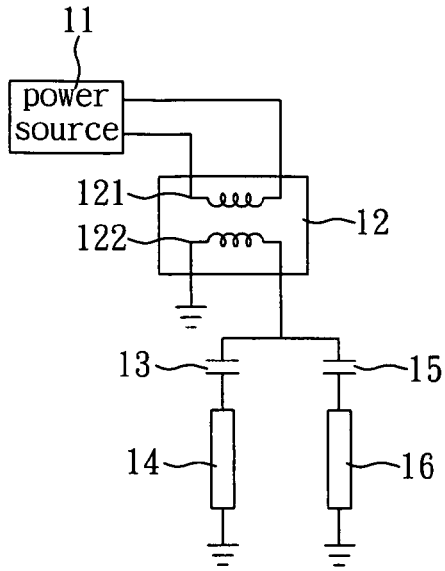
FIG. 1 (PRIOR ART)
FIG. 1 is a schematic view showing a conventional balanced current lamp circuit.
Figure 2:
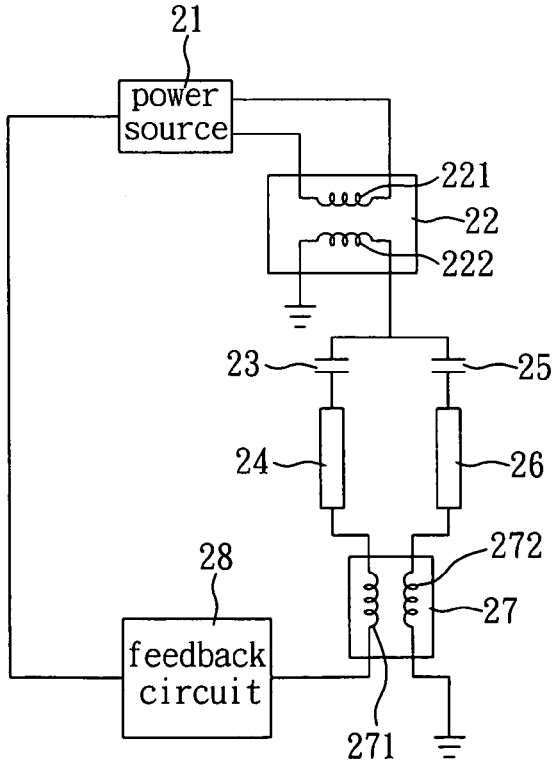
FIG. 2 (PRIOR ART)
FIG. 2 is a schematic view showing another conventional balanced current lamp circuit.
Figure 3:
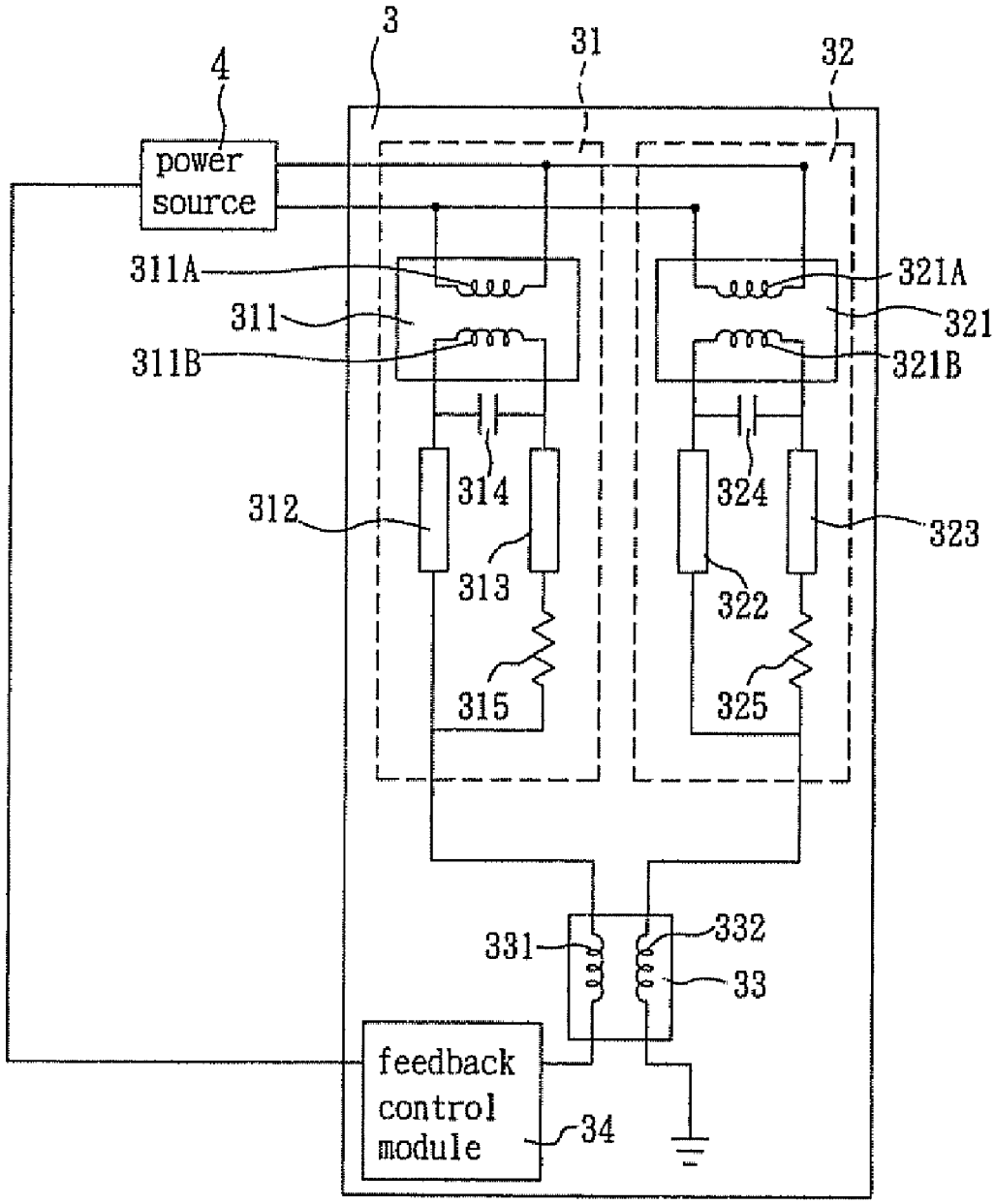
FIG. 3 is a schematic view showing a balanced current lamp module according to a preferred embodiment of the present invention.

As shown in FIG. 3, a balanced current lamp module 3 according to a preferred embodiment of the present invention, which is driven by a power source 4, includes a first balanced current unit 31, a second balanced current unit 32 and a balanced transformer 33.

The first balanced current unit 31 includes a first transformer 311, a first lamp 312 and a second lamp 313. The first transformer 311 has a first coil 311A having two ends electrically connected with the power source 4, and a second coil 311B having two ends respectively electrically connected with the first lamp 312 and the second lamp 313.

The second balanced current unit 32 includes a second transformer 321, a third lamp 322 and a fourth lamp 323. The second transformer 321 has a third coil 321A having two ends electrically connected with the power source 4, and a fourth coil 321B having two ends respectively electrically connected with the third lamp 322 and the fourth lamp 323.

The balanced transformer 33 has a fifth coil 331 and a sixth coil 332, the fifth coil 331 having one end electrically connected with the first lamp 312 and the second lamp 313, and the sixth coil 332 having one end electrically connected with the third lamp 322 and the fourth lamp 323. In this embodiment, the fifth coil 331 of the balanced transformer 33 is electrically connected with a feedback control module 34, and the first lamps 312, the second lamp 313, the third lamp 322 or the fourth lamp 323 may be a cold cathode fluorescent lamp.

In addition, the first balanced current unit 31 further includes a first capacitor 314 and a first resistor 315. The first capacitor 314 is connected in parallel with the second coil 311B of the first transformer 311 and connected between the first lamps 312 and the second lamp 313. The first resistor 315 is connected with the second lamp 313 in series. The resistor first 315 may be a fixed resistor, a positive temperature thermistor or a negative temperature thermistor.

The second balanced current unit 32 further includes a second capacitor 324 and a second resistor 325. The second capacitor 324 is connected in parallel with the fourth coil 321B of the second transformer 321 and connected between the third lamps 322 and the fourth lamp 323. The second resistor 325 is connected with the fouth lamp 323 in series. The second resistor 325 may be a fixed resistor, a positive temperature thermistor or a negative temperature thermistor.

The feedback control module 34, which is electrically connected with the fifth coil 331 of the balanced transformer 33, controls the power source 4 in a feedback manner according to working currents of the first lamps 312 and the second lamp 313, and thus adjusts the working currents of the first lamps 312, the second lamp 313, the third lamp 322 and the fourth lamp 323.

In this embodiment, one balanced transformer can balance the working currents of four lamps. Comparing with the prior art, the amount and cost of the balanced transformers of the present invention can be reduced, so each lamp can be ensured to have the same luminance.

Figure 4:
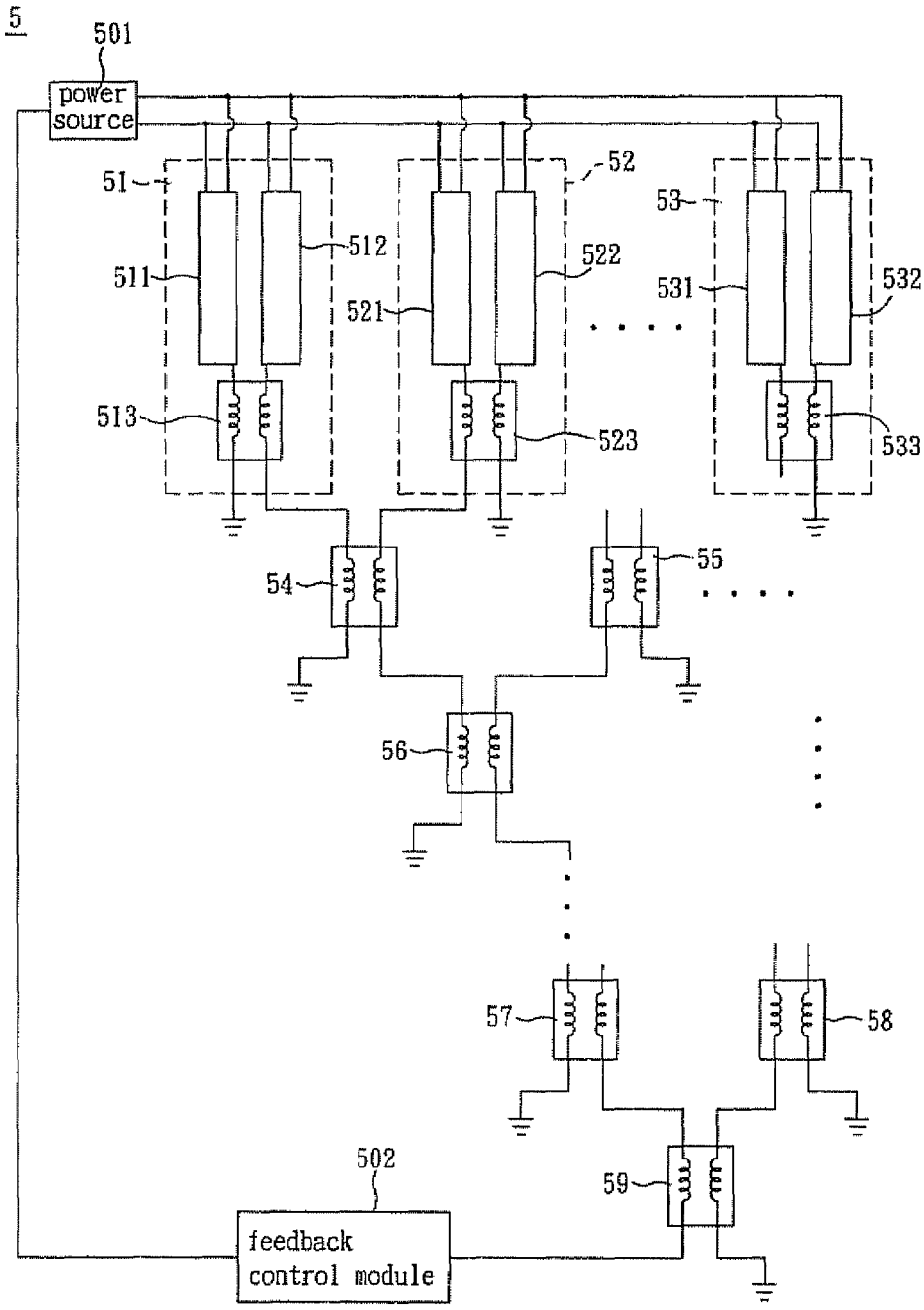
FIG. 4 is a schematic view showing a multi-lamp circuit according to a preferred embodiment of the present invention.

As shown in FIG. 4, a multi-lamp circuit 5 according to a preferred embodiment of the present invention, which is electrically connected with a power source 501, includes a plurality of balanced current lamp modules 51 to 53.

Each of the balanced current lamp modules 51 to 53 includes a plurality of balanced current units. For example, the balanced current lamp module 51 includes a balanced current unit 511, a balanced current unit 512 and a balanced transformer 513. For example, the balanced current unit 511 may include a transformer, two lamps, a capacitor and a resistor (not shown). The balanced current units 511, 512, 521, 522, 531, and 532 and the balanced transformers 513, 523 and 533 of FIG. 4 respectively have the same constructions and functions as those of the first balanced current unit 31, the second balanced current unit 32 and the balanced transformer 33 of the embodiment shown in FIG. 3. So, detailed description thereof will be omitted.

In addition, the multi-lamp circuit 5 further includes a plurality of sub-stage balanced transformers 54 to 59. The sub-1-stage balanced transformer 54 is electrically connected with the balanced current lamp modules 51 and 52. The sub-1-stage balanced transformer 55 is electrically connected with two of the balanced current lamp modules. The other sub-1-stage balanced transformers are electrically connected with two of the balanced current lamp modules.

The sub-2-stage balanced transformer 56 is electrically connected with the sub-1-stage balanced transformers 54 and 55. The other sub-2-stage balanced transformers are electrically connected with two of the sub-1-stage balanced transformers. The connection method is made in the similar manner. Thus, the sub-N-stage balanced transformer 59 is electrically connected with two of the sub-(N−1)-stage balanced transformers 57 and 58, wherein N is a natural number. Consequently, when the multi-lamp is arranged, the working current of each lamp can be balanced and unified according to a plurality of stages of balanced transformers, such that the luminance of each lamp can be unified.

In addition, the sub-N-stage balanced transformer 59 may be electrically connected with a feedback control module 502, which can control the power source 501 in a feedback manner according to a current flowing through the sub-N-stage balanced transformer 59 so as to adjust the working currents of the lamps in the balanced current lamp modules 51 to 53.

In summary, due to one coil of the transformer of each balanced current unit is electrically connected between two lamps in series, and two coils of the balanced transformer are respectively electrically connected with one of the balanced current units, the working currents of the lamps within each balanced current unit are the same. Comparing with the prior art, a balanced current lamp module and a multi-lamp circuit according to the present invention can decrease the amount and cost of the balanced transformers, and ensure each lamp to have the same luminance.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A balanced current lamp module driven by a power source, the lamp module comprising:

a first balanced current unit comprising a first transformer; a first lamp and a second lamp, wherein the first transformer has a first coil having two ends electrically connected with the power source and a second coil having two ends respectively electrically connected with the first lamp and the second lamp;

a second balanced current unit comprising a second transformer, a third lamp and a fourth lamp, wherein the second transformer has a third coil having two ends electrically connected with the power source, and a fourth coil having two ends respectively electrically connected with the third lamp and the fourth lamp; and a balanced transformer comprising a fifth coil and a sixth coil, wherein the fifth coil having one end electrically connected with the first lamp and the second lamp, and the sixth coil having one end electrically connected with the third lamp and the fourth lamp.

2. The balanced current lamp module according to claim 1, wherein the first lamp, the second lamp, the third lamp or the fourth lamp is a cold cathode fluorescent lamp.

3. The balanced current lamp module according to claim 1, wherein the first balanced current unit further comprises a first capacitor connected in parallel with the second coil of the first transformer and connected between the first lamp and the second lamp.

4. The balanced current lamp module according to claim 1, wherein the second balanced current unit further comprises a second capacitor connected in parallel with the fourth coil of the second transformer and connected between the third lamp and the fourth lamp.

5. The balanced current lamp module according to claim 1, wherein the second lamp or the fourth lamp is connected with a resistor in series.

6. The balanced current lamp module according to claim 5, wherein the resistor is a fixed resistor, a positive temperature thermistor or a negative temperature thermistor.

7. The balanced current lamp module according to claim 1, further comprising a feedback control module electrically connected with the other end of the fifth coil of the balanced transformer.

8. A multi-lamp circuit electrically connected with a power source, comprising:

a plurality of balanced current lamp modules, each of which comprises a first transformer having first and second coils, a second transformer having third and fourth coils, a first lamp, a second lamp, a third lamp, a fourth lamp and a balanced transformer having fifth and sixth coils, wherein two ends of the first coil of the first transformer and two ends of the third coil of the second transformer are electrically connected with the power source, two ends of the second coil of the first transformer are respectively electrically connected with the first lamp and the second lamp, two ends of the fourth coil of the second transformer are respectively electrically connected with the third lamp and the fourth lamp, one end of the fifth coil of the balanced transformer is electrically connected with the first lamp and the second lamp, and one end of the sixth coil of the balanced transformer is electrically connected with the third and the fourth lamp.

9. The multi-lamp circuit according to claim 8, wherein the first lamp, the second lamp, the third lamp or the fourth lamp is a cold cathode fluorescent lamp.

10. The multi-lamp circuit according to claim 8, wherein the balanced current lamp unit further comprises a first capacitor and a second capacitor, the first capacitor is connected in parallel with the second coil of the first transformer and connected between the first and second lamps, and the second capacitor is connected in parallel with the fourth coil of the second transformer and connected between the third and fourth lamps.

11. The multi-lamp circuit according to claim 8, wherein the second lamp or the fourth lamp is connected with a resistor in series.

12. The multi-lamp circuit according to claim 11, wherein the resistor is a fixed resistor, a positive temperature thermistor or a negative temperature thermistor.

13. The multi-lamp circuit according to claim 8, further comprising:

at least one sub-1-stage balanced transformer having a seventh coil and a eightht coils, wherein the seventh coil has one end respectively electrically connected with the other end of the sixth coil of the balanced current lamp module, and the eighth coil has one end electrically connected with the other end of the fifth coil of the adjacent two of the balanced current lamp modules.

14. The multi-lamp circuit according to claim 13, further comprising a feedback control module electrically connected with the other end of the eighth coil of the sub-1-stage balanced transformer.

15. The multi-lamp circuit according to claim 13, further comprising: at least one sub-2-stage balanced transfonner having two coils, wherein one end of each coil respectively electrically connected with the other end of the eighth coil of the sub-1-stage balanced transformers.

16. The multi-lamp circuit according to claim 15, further comprising a feedback control module electrically connected with the other end of one of the two coils of the sub-N-stage balanced.

17. A multi-lamp circuit electrically connected with a power source, comprising:

a plurality of balanced current lamp modules, each of which comprises a first transformer having two coils, a second transformer having two coils, a first lamp, a second lamp, a third lamp, a fourth lamp and a balanced transformer having two coils, wherein two ends of one coil of the first transformer and two ends of one coil of the second transformer are electrically connected with the power source, two ends of the other coil of the first transformer are respectively electrically connected with the first lamp and the second lamp, two ends of the other coil of the second transformer are respectively electrically connected with the third lamp and the fourth lamp, one end of one coil of the balanced transformer is electrically connected with the first lamp and the second lamp, and one end of the other coil of the balanced transformer is electrically connected with the third lamp and the fourth lamp; and a plurality of sub-stage balanced transformers, each of which comprises two coils, wherein one end of each of the two coils of the sub-1-stage balanced transformer are respectively electrically connected with the other end of the other coil of each of the two balanced transformers, and wherein one end of each of the two coils of the sub-N-stage balanced transformer are respectively electrically connected with the other end of the other coil of each of the two sub-(N−1)-stage balanced transformers.

18. The multi-lamp circuit according to claim 17, wherein the first lamp, the second lamp, the third lamp or the fourth lamp is a cold cathode fluorescent lamp.

19. The multi-lamp circuit according to claim 17, wherein the balanced current lamp unit further comprises a first capacitor and a second capacitor, the first capacitor is connected in parallel with the other coil of the first transformer and connected between the first lamp and the second lamp, and the second capacitor is connected in parallel with the other coil of the second transformer and connected between the third lamp and the fourth lamp.

20. The multi-lamp circuit according to claim 17, further comprising a feedback control module electrically connected with the other end of one coil of the sub-N-stage balanced transformer.

21. The multi-lamp circuit according to claim 15, further comprising at least one sub-N-stage balanced transformer having two coils, wherein one end of each coil respectively electrically connected with the other end of the coils of the sub-(N−1)-stage balanced transformers.

* * * * *